US008214925B2

(12) United States Patent
Yu

(10) Patent No.: US 8,214,925 B2
(45) Date of Patent: Jul. 10, 2012

(54) TOOL HOLDING GLOVE

(76) Inventor: David Chen Yu, Laguna Niguel, CA (US)

( * ) Notice: Subject to any disclaimer, the term of this patent is extended or adjusted under 35 U.S.C. 154(b) by 242 days.

(21) Appl. No.: 12/815,050

(22) Filed: Jun. 14, 2010

(65) Prior Publication Data

US 2011/0302693 A1 Dec. 15, 2011

(51) Int. Cl.
*A41D 19/00* (2006.01)

(52) U.S. Cl. ..... 2/161.6; 2/160; 2/161.1

(58) Field of Classification Search ..... 2/161.1, 2/161.6, 161.8, 161.2, 161.3, 161.4, 163, 2/160, 159, 162, 16, 17, 910, 917; 473/205
See application file for complete search history.

(56) References Cited

U.S. PATENT DOCUMENTS 2,751,598 A * 6/1956 Romeo ..... 2/161.3
2,852,779 A * 9/1958 Roessler ..... 2/161.2
3,105,972 A * 10/1963 Christopher ..... 2/161.2
3,348,238 A * 10/1967 Hydock ..... 2/161.2
3,559,212 A * 2/1971 Skovron ..... 2/161.4
4,827,535 A * 5/1989 Socey ..... 2/158
5,022,094 A * 6/1991 Hames et al. ..... 2/163
5,033,120 A * 7/1991 Myers ..... 2/161.3
5,316,294 A * 5/1994 Turangan ..... 473/573
5,414,868 A * 5/1995 Crawford ..... 2/160
5,435,013 A * 7/1995 Davis ..... 2/161.1
5,845,374 A * 12/1998 Briggs ..... 24/442
6,006,358 A * 12/1999 Keating ..... 2/161.1
6,035,442 A * 3/2000 Marando ..... 2/161.1
6,073,269 A * 6/2000 Diaco ..... 2/160
6,223,354 B1 * 5/2001 Carothers ..... 2/161.2
6,393,615 B1 * 5/2002 Bedell ..... 2/161.1
7,337,474 B1 * 3/2008 Godson ..... 2/161.2

* cited by examiner

*Primary Examiner* — Amy Vanatta
(74) *Attorney, Agent, or Firm* — Tran & Associates

(57) ABSTRACT

Methods and apparatus for securely holding a tool are provided. The apparatus includes a glove covering a user's palm and fingers. This flap has a piece of adhesive fabric attached. An additional piece of adhesive fabric is placed on the glove over the user's thumb pad. On the back of the user's hand, over the user's fingernails are located additional pieces of adhesive fabric. In use, the user grasps the tool normally and uses the flap and the adhesive fabric pieces to secure the adhesive fabric, forming a secure grip.

7 Claims, 4 Drawing Sheets

TOOL HOLDING GLOVE

BACKGROUND

1. Field

The present disclosure relates generally to tools and their use, and, in particular, to an apparatus and method for holding tools securely with a glove.

2. Background

The construction industry has seen the arrival of many electrical and other specialty tools. These tools offer the ability to perform construction tasks, such as cutting or nailing using more power. In addition, the power tools provide quicker and more precise operations. Nail guns give the contractor the ability to install more nails in a given period of time than could be placed by hand with a hammer. Greater uniformity of pressure and correct placement are facilitated with a nail gun. Similarly, an electric saw is much faster than a hand saw. When used correctly these tools can significantly speed up many common construction tasks.

The benefit of these tools is not without cost, however. Because the tools often incorporate electric motors or pneumatic apparatus, these tools are heavier. Often the user must be aware of a power cord and must maneuver the cord to perform operations. For ease of operation, many tools are designed to be held and operated with just one hand. No matter how well designed the power tool; in general, power tools are much heavier than their traditional counterparts.

The heavier weight of power tools may lead to fatigue in the user's hands. Given the increase in weight, it is possible that a user may lose his or her grip on a tool, which may result in poor workmanship, or an accident. The weight of power tools also requires that a user maintain a clear focus while holding, using, and manipulating the tools. Even if fatigue is not a problem, a distracted user could easily lose control of a power tool and injure himself or others nearby.

The injuries caused by power tools may range from simple bruises from a dropped tool, up to severe cuts and lacerations from grip loss on a power saw. There is a need in the art for a glove to assist a user in retaining and controlling a power tool.

SUMMARY

A glove for securely holding or grasping a tool is provided by embodiments of the invention. The glove has a flap attached to the wrist area of the palm side of the glove. This flap has a piece of adhesive fabric attached to the flap, which faces up when the user's hand is palm upward. A piece of adhesive fabric is also attached to the area of the glove over the pad of the user's thumb. Similar pieces of adhesive fabric are attached to the back side of the glove, directly over the user's fingernails.

A method of holding a tool is provided. The method comprises: wearing a glove having a flap and adhesive fabric pieces, the flap attached to a wrist area of the glove and having an adhesive fabric piece attached, the adhesive fabric pieces attached to a pad of a thumb and backs of fingers. The user then grasps the tool normally, and secures the flap and adhesive fabric pieces around the tool and secures the flap and adhesive fabric pieces around the tool.

An apparatus for holding a tool is provided. The apparatus is comprised of means for covering a user's palm and fingers with a glove; means for fabric adhesion fixed to a flap attached to a wrist area of the glove; means for fabric adhesion fixed to a pad of a thumb; and means for fabric adhesion fixed to backs of fingers. Various aspects and embodiments of the invention are described in further detail below.

DETAILED DESCRIPTION

Figure 1:
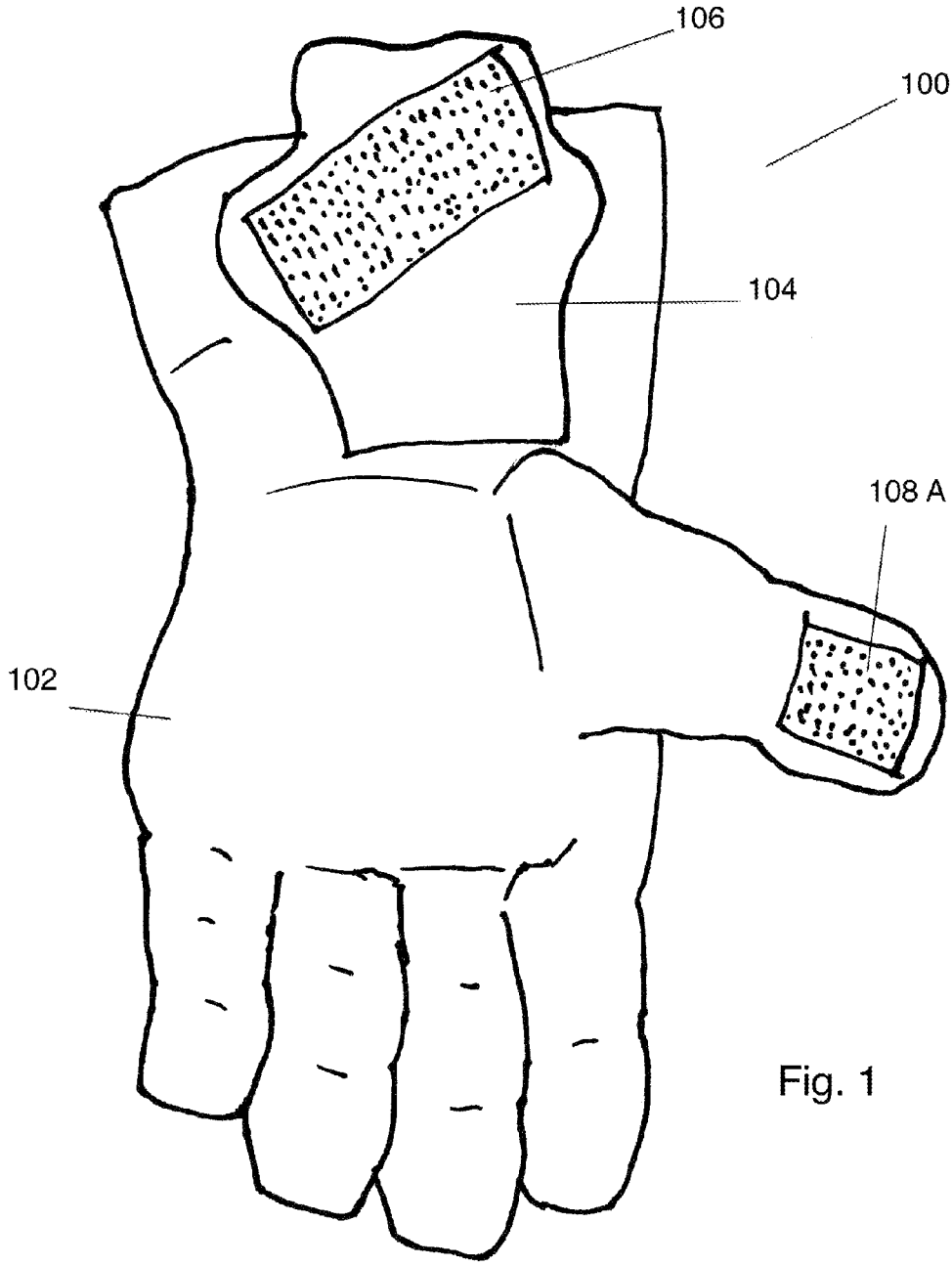
FIG. 1 is an illustration of the palm side of a tool holding glove, in accordance with various embodiments of the present invention.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiments) may be practiced without these specific details. In other instances, well-known structures and devices are shown in block diagram form in order to facilitate describing one or more embodiments.

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

Referring to FIG. 1, a tool holding glove 100, according to one embodiment is illustrated. FIG. 1 shows the palm side of the tool holding glove 100. The glove portion 102 is similar to workman's gloves, typically worn by craft workers while performing tasks. The glove portion 102 may be made from leather or other sturdy and protective material. The glove portion extends beyond the wearer's wrist and partially up the wearer's forearm. A flap 104 is attached in the wrist area, according to an embodiment of the invention. This flap 104 has attached adhesive fabric piece 106. Adhesive fabric piece 106 may be one part of a hook and loop adhesive fabric, that when mated lock together. Alternatively, fabric piece 106 may be any other adhesive fabric capable of repeated joining and separating without requiring replacement. A thumb pad piece 108 A is made of the same adhesive fabric as fabric piece 106.

Figure 2:
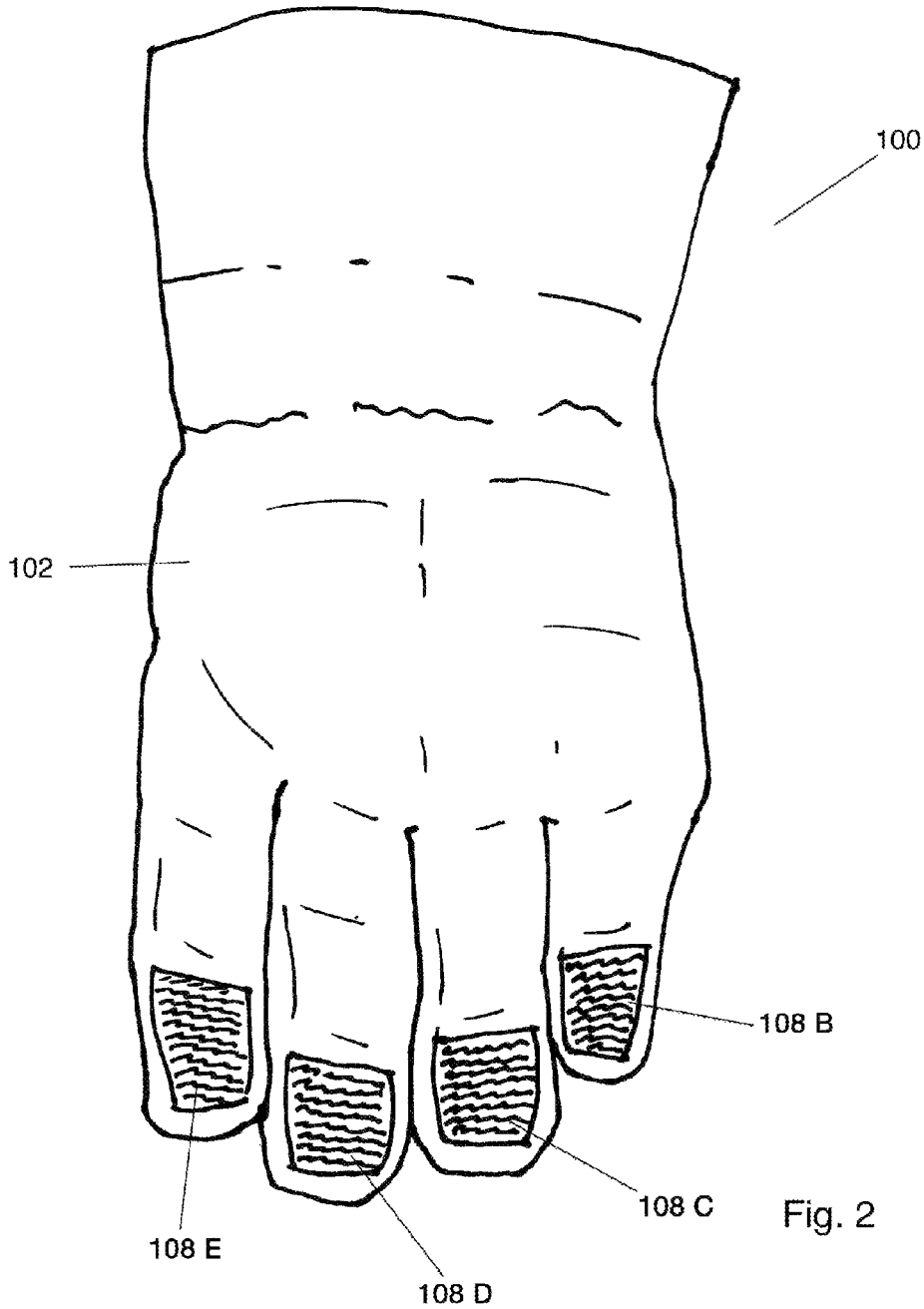
FIG. 2 is an illustration of the back of the hand side of a tool holding glove, in accordance with one or more embodiments the present invention.

FIG. 2 illustrates the reverse side, or back of the wearer's hand side of the tool holding glove. The glove portion 102 is shown looking down on the back of the wearer's hand with four fingers visible. The portions of the glove on the back of the wearer's fingers, above the wearer's fingernails, are covered with adhesive fabric pieces 108 B-E. These fabric pieces 108 B-E are also made of a hook and loop adhesive fabric, and are of a type opposite that of the fabric piece 106 attached to flap 104, in order to provide adhesion when mated together.

Figure 3:
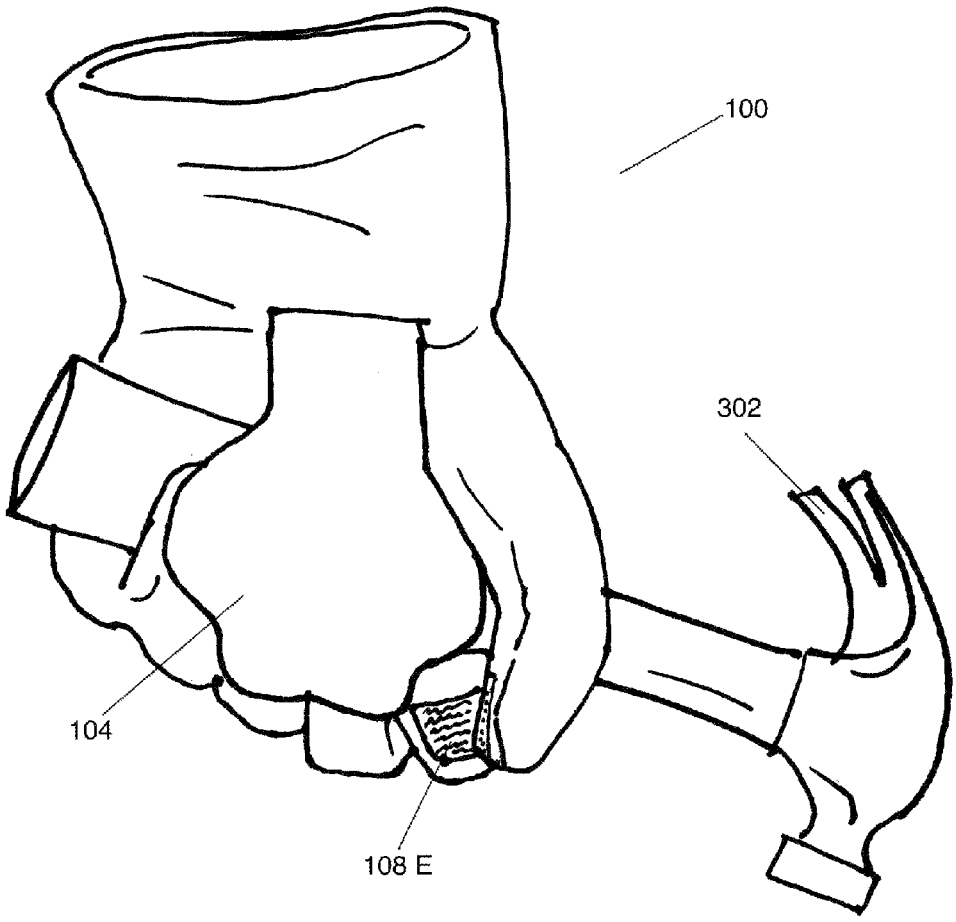
FIG. 3 is an illustration of a tool holding glove in use, according to one or more embodiments of the present invention.

FIG. 3 illustrates use of the tool holding glove. The user puts on the glove as he or she would a typical glove. The wearer then picks up the tool 302 to be retained by the tool holding glove. The thumb and index finger encircle the tool and thumb pad piece 108 A is pressed against adhesive fabric piece 108 E, which covers the wearer's index finger. Pressing the thumb pad piece 108 A against adhesive fabric piece 108 E forms a secure grip around the tool, 302. In a similar manner, the adhesive fabric piece 106, attached to flap 104 is pressed against fabric pieces 108 B-D to complete the grip on the tool 302.

Once the grip on the tool 302 has been formed the wearer has a secure hold on the tool 302. The wearer may even relax the grip of his or her muscles and the tool holding glove will retain the tool 302 within the tool holding glove 100.

The wearer may break the grip established by the tool holding glove by grasping the flap 104 and separating adhesive fabric piece 106 from adhesive fabric pieces 108 B-D. In a similar fashion, the thumb piece 108 A is separated from adhesive fabric piece 108 E, over the wearer's index finger.

A further embodiment of the tool holding glove varies the location of flap 104. Specifically, flap 104 may be located further away from the wearer's wrist, up the forearm. This embodiment prevents flap 104 from being tangled in the grip of the wearer's hand. In a further embodiment, fabric piece 108 E may also be located closer to the base of the wearer's thumb. This embodiment facilitates a tighter grasp of tools with a small gripping diameter.

Yet another embodiment facilitates opening the flap 104 to release the grip. Flap 104 may be shaped with an "ear" on the top of flap 104, parallel with the wearer's wrist. This "ear" provides easier opening with which to initiate separation of the adhesive fabric pieces 106 and 108 B-D.

A still further embodiment facilitates opening the grip with the wearer's other hand. Flap 104 may have "ears" or rounded portions on the sides. These "ears" allow a wearer to grasp flap 104 with the fingers of the other hand and then separate adhesive fabric piece 106 and adhesive fabric pieces 108 B-D.

Figure 4:
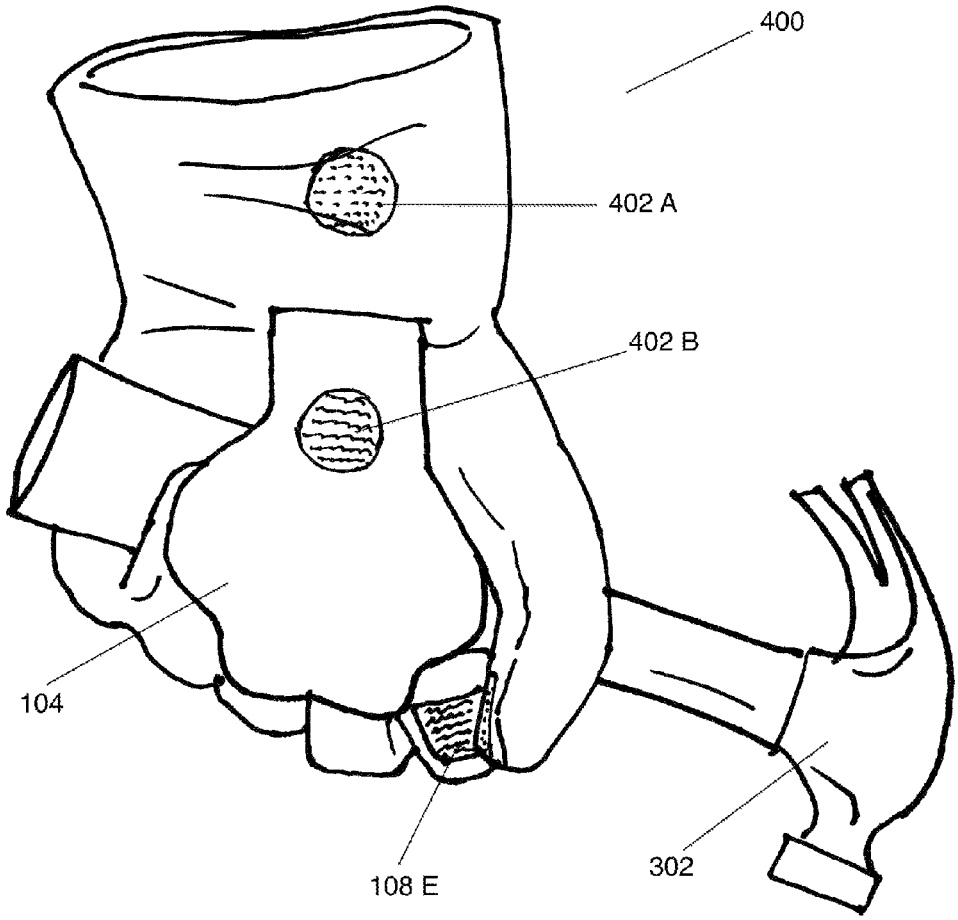
FIG. 4 is an illustration of a tool holding glove incorporating a flap holder, in use, in accordance with a further embodiment of the invention

Yet a further embodiment provides for holding the flap 104 when the tool holding feature is not in use. FIG. 4 provides a tool holding glove, 400, incorporating flap 104, positioned as described above. Adhesive fabric pieces 402 A and 402 B are affixed to flap 104 as shown. Specifically, the wrist of the glove 400 has adhesive fabric piece 402 A affixed above the attachment point for flap 104. Flap 104 has adhesive fabric piece 402 B affixed to the outer side of flap 104, facing away from the palm of the user. When the flap 104 is not in use, adhesive fabric pieces 402 A and 402 B are used to hold flap 104 against the wrist of the user and prevent flap 104 from tangling in the user's hand.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

The invention claimed is:

1. A glove for holding a tool, comprising:

a glove;

a flap covering three or more glove fingers and having one end permanently attached to a wrist area of a palm side of the glove, having adhesive fabric attached to a front side of the flap with a plurality of rounded portions or ears on the sides to provide openings to initiate separation of the adhesive fabric, wherein the flap includes a first attachment piece on a back side of the flap to secure the flap to a second attachment piece on the glove and adapted to engage the back side of the flap when not used;

pieces of adhesive fabric attached to a back side of fingers of the glove;

wherein the adhesive fabric of the flap mates with the pieces of adhesive fabric on the fingers to removably attach the flap to the back sides of the three or more fingers; and a piece of adhesive fabric attached to a thumb pad which mates with the adhesive fabric of another finger to removably attach the thumb to the finger.

2. The glove of claim 1, wherein the flap is located on a user's forearm.

3. The glove of claim 1, wherein the adhesive fabric attached to a thumb pad is located proximal to a base of a user's thumb.

4. A method of holding a tool, comprising:

wearing a glove having a flap and adhesive fabric pieces, the flap attached to a wrist area of the glove and having an adhesive fabric piece attached, the adhesive fabric pieces attached to a pad of a thumb and backs of fingers wherein the flap covers three or more glove fingers and having one end permanently attached to a wrist area of a palm side of the glove, having adhesive fabric attached to a front side of the flap with a plurality of rounded portions or ears on the sides to provide openings to initiate separation of the adhesive fabric, wherein the flap includes a first attachment piece on a back side of the flap to secure the flap to a second attachment piece on the glove and adapted to engage the back side of the flap when not used wherein the adhesive fabric of the flap mates with the pieces of adhesive fabric on the fingers to removably attach the flap to the back sides of the three or more fingers; and the piece of adhesive fabric attached to the thumb pad mates with the adhesive fabric of another finger to removably attach the thumb to the finger;

grasping the tool; and securing the flap and adhesive fabric pieces around the tool; and initiating separation of the adhesive fabric with the rounded portions or ears and securing the flap with the first attachment piece to the second attachment piece on the glove when not used.

5. An apparatus for holding a tool, comprising:

means for covering a user's palm and fingers with a glove;

means for fabric adhesion fixed to a flap covering three or more glove fingers and permanently attached to a wrist area of the glove with a plurality of rounded portions or ears on the sides to provide openings to initiate separation of the adhesive fabric, wherein the flap includes a first attachment piece on a back side of the flap to secure the flap to a second attachment piece on the glove and adapted to engage the back side of the flap when not used;

means for fabric adhesion fixed to a pad of a thumb;

and means for fabric adhesion fixed to backs of fingers;

wherein the means for fabric adhesion of the flap mates with the means for fabric adhesion of the fingers to removably attach the flap to the back sides of the three or more fingers; and the means for fabric adhesion of the thumb mates with the means for fabric adhesion of another finger to removably attach the thumb to the finger.

6. The apparatus for holding a tool of claim 5, wherein the flap is attached to a user's forearm.

7. The apparatus for holding a tool of claim 5, wherein the adhesive fabric attached to a thumb pad is located proximal to a base of a user's thumb.

* * * * *